US009081408B2

(12) United States Patent
Ooya et al.

(10) Patent No.: US 9,081,408 B2
(45) Date of Patent: Jul. 14, 2015

(54) ACCELERATION DEVICE

(71) Applicant: DENSO CORPORATION, Kariya, Aichi-pref. (JP)

(72) Inventors: Masahiro Ooya, Chita-gun (JP); Masahiro Makino, Kariya (JP); Takehiro Saito, Anjo (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/196,275

(22) Filed: Mar. 4, 2014

(65) Prior Publication Data

US 2014/0251068 A1 Sep. 11, 2014

(30) Foreign Application Priority Data

Mar. 5, 2013 (JP) ..... 2013-43050

(51) Int. Cl.
*G05G 1/30* (2008.04)
*G05G 1/44* (2008.04)
*G05G 5/03* (2008.04)

(52) U.S. Cl.
CPC .. *G05G 1/44* (2013.01); *G05G 5/03* (2013.01); *Y10T 74/20534* (2015.01)

(58) Field of Classification Search
CPC ..... G05G 1/30; G05G 1/38; G05G 1/405; G05G 5/03; G05G 1/44
USPC ..... 74/512–514, 560
See application file for complete search history.

(56) References Cited

U.S. PATENT DOCUMENTS

| | | | | |
|---|---|---|---|---|
| 7,012,423 | B2 * | 3/2006 | Hasegawa et al. | 324/207.25 |
| 8,539,858 | B2 * | 9/2013 | Saito et al. | 74/513 |
| 8,783,129 | B2 * | 7/2014 | Saito et al. | 74/513 |
| 8,925,418 | B2 * | 1/2015 | Saito et al. | 74/513 |
| 2006/0117902 | A1 * | 6/2006 | Martin et al. | 74/512 |
| 2014/0096639 | A1 * | 4/2014 | Saito et al. | 74/513 |
| 2015/0007684 | A1 * | 1/2015 | Saito et al. | 74/513 |

FOREIGN PATENT DOCUMENTS

| | | | |
|---|---|---|---|
| JP | 2004-090755 | | 3/2004 |
| JP | 2008183974 A | * | 8/2008 |

* cited by examiner

*Primary Examiner* — Thomas R. Hannon
*Assistant Examiner* — Adam D Rogers
(74) *Attorney, Agent, or Firm* — Nixon & Vanderhye PC

(57) ABSTRACT

Each of a cross sectional shape of a contacting portion of a stopper arm and a cross sectional shape of an outer peripheral surface of a pedal shaft is formed in a circular shape, wherein a curvature radius is equal to each other. Each of a cross sectional shape of a stopper surface of a supporting body and a cross sectional shape of an inner peripheral surface of a bearing portion is formed in a circular shape, wherein a curvature radius is equal to each other. A distance between a center of a first virtual circle formed by the contacting portion and a center axis of the pedal shaft is made to be equal to a distance between a center of a second virtual circle formed by the stopper surface and a center axis of the bearing portion. An angle of the stopper arm with respect to the supporting body is not changed, even when the center axis of the pedal shaft is displaced with respect to center axis of the bearing portion.

3 Claims, 8 Drawing Sheets

ACCELERATION DEVICE

CROSS REFERENCE TO RELATED APPLICATION

This application is based on Japanese Patent Application No. 2013-043050 filed on Mar. 5, 2013, the disclosure of which is incorporated herein by reference.

FIELD OF TECHNOLOGY

The present disclosure relates to an acceleration device for an automotive vehicle.

BACKGROUND

In an acceleration device for an automotive vehicle for controlling a vehicle acceleration condition depending on a stepping stroke amount of an acceleration pedal, which is operated by a vehicle driver, a rotational angle sensor detects a rotational angle of a pedal shaft for the acceleration pedal. A rotational angle of the pedal shaft corresponds to the stepping stroke amount of the acceleration pedal. The acceleration device has a stopper member rotated together with the pedal shaft. A contacting portion of the stopper member is brought into contact with a stopper surface of a supporting body of the acceleration device when the acceleration pedal is in its acceleration fully-closed position, so that the rotation of the pedal shaft is limited at a predetermined rotational angle.

In a known acceleration device, for example, as disclosed in Japanese Patent Publication No. 2004-090755, an elastic member is provided at an inner wall of a supporting body and a contacting portion of a stopper member is brought into contact with the elastic member, which is elastically deformed. The elastic member is provided in order to decrease hammering sound, which is generated when the contacting portion is brought into contact with the supporting body.

In the acceleration device of the above Japanese Patent Publication No. 2004-090755, each of the contacting portion and the elastic member is formed in a flat surface. The contacting portion of the stopper member is in contact with the inner wall of the supporting body when an acceleration pedal is in its fully-closed position. When a position of a center axis of a pedal shaft with respect to a center axis of a bearing for rotatably supporting the pedal shaft is displaced, a virtual straight line connecting a center of the contacting portion and the center axis of the pedal shaft with each other is declined from a virtual straight line of an initial condition of the acceleration device. As a result, a rotational angle of the pedal shaft in an acceleration fully-closed condition becomes different from that in the initial condition, when the position of the center axis of the pedal shaft with respect to the center axis of the bearing for the pedal shaft is displaced. Then, the rotational angle of the pedal shaft detected by a rotational angle sensor, which is detected in the acceleration fully-closed condition, becomes unstable.

SUMMARY OF THE DISCLOSURE

The present disclosure is made in view of the above problem. It is an object of the present disclosure to provide an acceleration device, according to which a rotational angle of a pedal shaft detected by an angle sensor can be stabilized in an acceleration fully-closed condition.

According to a feature of the present disclosure, an acceleration device for an automotive vehicle is composed of:

an acceleration pedal to be operated by a vehicle driver;

a supporting body to be fixed to a vehicle body;

a pedal shaft rotatably supported by a bearing portion formed in the supporting body;

a boss portion attached to and rotated together with the pedal shaft;

a stopper arm connected to the boss portion and arranged in an inner space formed by the supporting body, the stopper arm having a contacting portion which is brought into contact with a stopper surface of the supporting body when the acceleration pedal is in an acceleration fully-closed position;

a pedal arm for connecting the acceleration pedal to the boss portion;

a rotational angle detecting unit for detecting a rotational angle of the pedal shaft with respect to the supporting body; and a biasing member for biasing rotation of the pedal shaft in an acceleration closing direction.

In the above acceleration device, each of an outer surface of the contacting portion and an outer peripheral surface of the pedal shaft is formed by a curved surface, each of a curvature radius for the curved surface of the contacting portion and a curvature radius for the curved surface of the outer peripheral surface of the pedal shaft is changed in its circumferential direction on a virtual plane perpendicular to a center axis of the pedal shaft, and variations of the curvature radius are equal to each other between the curved surface of the contacting portion and the curved surface of the outer peripheral surface of the pedal shaft.

Furthermore, in the above acceleration device, each of the stopper surface of the supporting body and an inner peripheral surface of the bearing portion is formed by a curved surface, each of a curvature radius for the curved surface of the stopper surface and a curvature radius for the curved surface of the inner peripheral surface of the bearing portion is changed in its circumferential direction on the virtual plane perpendicular to the center axis of the pedal shaft, and variations of the curvature radius are equal to each other between the curved surface of the stopper surface and the curved surface of the inner peripheral surface of the bearing portion.

Furthermore, in the above acceleration device, a distance between a center of a first virtual round shape and the center axis of the pedal shaft is equal to a distance between a center of a second virtual round shape and a center axis of the bearing portion. And the first virtual round shape includes the curved surface of the contacting portion as a part of the first virtual round shape on the virtual plane perpendicular to the center axis of the pedal shaft, while the second virtual round shape includes the curved surface of the stopper surface of the supporting body as a part of the second virtual round shape on the virtual plane perpendicular to the center axis of the pedal shaft.

According to the above features of the acceleration device, when a position of the center axis of the pedal shaft with respect to the center axis of the bearing portion is displaced from its initial position in an acceleration fully-closed condition, a first virtual straight line is shifted to a second virtual straight line, which is parallel to the first virtual straight line. The first virtual straight line corresponds to such a line, which connects the center of the first virtual round shape and the center axis of the pedal shaft to each other in the initial position. The second virtual straight line corresponds to such a line, which connects the center of the first virtual round shape and the center axis of the pedal shaft to each other in the displaced position. As a result, an angle of the contacting portion with respect to the stopper surface is equal to an angle of the pedal shaft with respect to the bearing portion, even after the center axis of the pedal shaft is displaced with respect to the center axis of the bearing portion.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
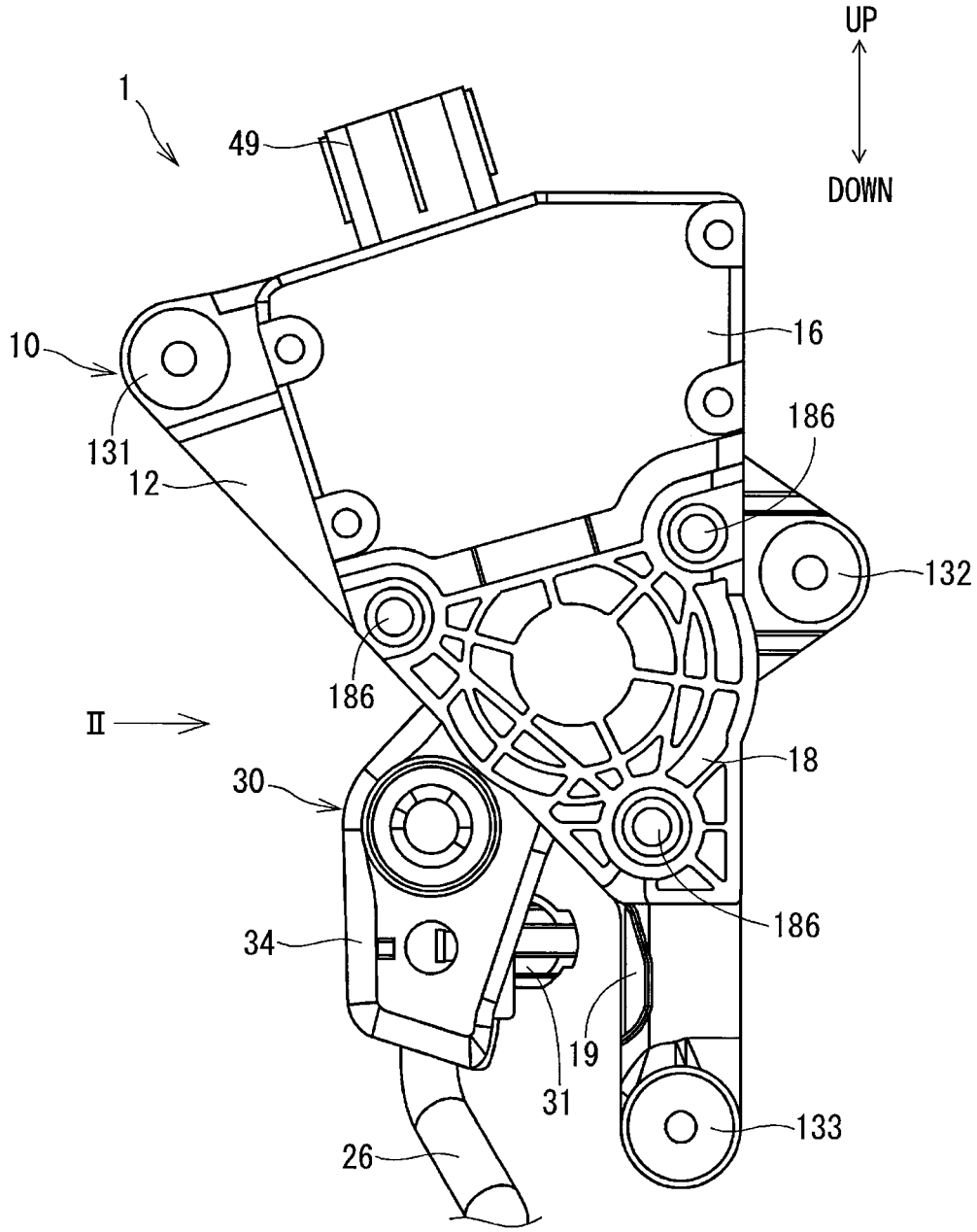
FIG. 1 is a schematic front view showing an acceleration device according to an embodiment of the present disclosure.

The present disclosure will be explained hereinafter with reference to the drawings.

An acceleration device 1 for an automotive vehicle according to an embodiment of the present disclosure is shown in FIGS. 1 to 7. The acceleration device 1 is an input device, which is operated by a vehicle driver in order to control a valve opening degree of a throttle valve (not shown) for an internal combustion engine of the automotive vehicle. The acceleration device 1 is of an electronically operated type and outputs an electrical signal representing a stepping stroke amount of an acceleration pedal 28. The electrical signal is transmitted to an electronic control unit (not shown). The electronic control unit drives the throttle valve by a throttle actuator (not shown) based on the stepping stroke amount and other vehicle information.

The acceleration device 1 is composed of a supporting body 10, a pedal shaft 20, a rotating member 30, a pedal arm 26, the acceleration pedal 28, a return spring 39, a rotational angle sensor 40, a hysteresis mechanism 50 and so on. In FIGS. 1 to 4, "UP" is an upper side in a vertical direction, while "DOWN" is a lower side in the vertical direction.

The supporting body 10 is composed of a housing 12, a first cover member 16 and a second cover member 18. The supporting body 10 forms an inner space 11 for accommodating the pedal shaft 20, the return spring 39, the rotational angle sensor 40, the hysteresis mechanism 50 and so on. An opening 111 is formed at a lower portion of the supporting body 10 for communicating the inner space 11 to an outside of the supporting body 10. The opening 111 corresponds to a movable range of the rotating member 30, as explained below.

The housing 12 is made of resin and composed of a shaft supporting portion 13 for rotatably supporting one axial end 201 of the pedal shaft 20 (hereinafter, a first axial end 201), a front-side wall portion 17 formed at a front side of the acceleration device 1 and connected to the shaft supporting portion 13, a back-side wall portion 15 formed at a back side of the acceleration device 1, an upper-side wall portion 14 formed at an upper side of the acceleration device 1 and connecting the shaft supporting portion 13 and the front-side wall portion 17 to the back-side wall portion 15, and so on. Outer wall surfaces of the shaft supporting portion 13, the front-side wall portion 17, the back-side wall portion 15 and the upper-side wall portion 14 are formed with patterned indented surfaces. In other words, the outer wall surfaces are formed with net-like concavities and convexities, in order to increase rigidity against external forces applied to the housing 12.

A circular opening, into which the first axial end 201 of the pedal shaft 20 is movably inserted, is formed in the shaft supporting portion 13, so that the pedal shaft 20 is rotatable in the circular opening. In other words, an inner peripheral surface of the circular opening corresponds to a bearing portion 130 for rotatably supporting the first axial end 201 of the pedal shaft 20. A gap is inevitably formed between the inner peripheral surface of the bearing portion 130 and an outer peripheral surface of the pedal shaft 20. A structure of the bearing portion 130 will be explained more in detail below.

As shown in FIG. 1, multiple fixing portions 131, 132 and 133 are formed in the housing 12. A bolt-hole is formed in each of the fixing portions 131, 132 and 133. The acceleration device 1 is fixed to a vehicle body 5 by multiple bolts (not shown), each of which is inserted through the respective bolt-hole.

A full-open side stopping surface 19 of a recessed shape (hereinafter, a stopping surface 19) is formed at a lower side of the back-side wall portion 15. A full-open side stopper pin 31 of a convex shape (hereinafter, a stopper pin 31) is formed in the rotating member 30. When the stopper pin 31 is brought into contact with the stopping surface 19, a rotational movement of the rotating member 30 is stopped in an acceleration opening direction (that is, an anti-clockwise direction in FIG. 3). In other words, when the stopper pin 31 is in contact with the stopping surface 19, the rotating member 30 is held at its fully-opened position, which corresponds to an acceleration fully-opened position. The acceleration fully-opened position corresponds to a position, in which opening degree of the acceleration pedal 28 (that is, the stepping stroke amount of the acceleration pedal 28) is 100%.

Figure 4:
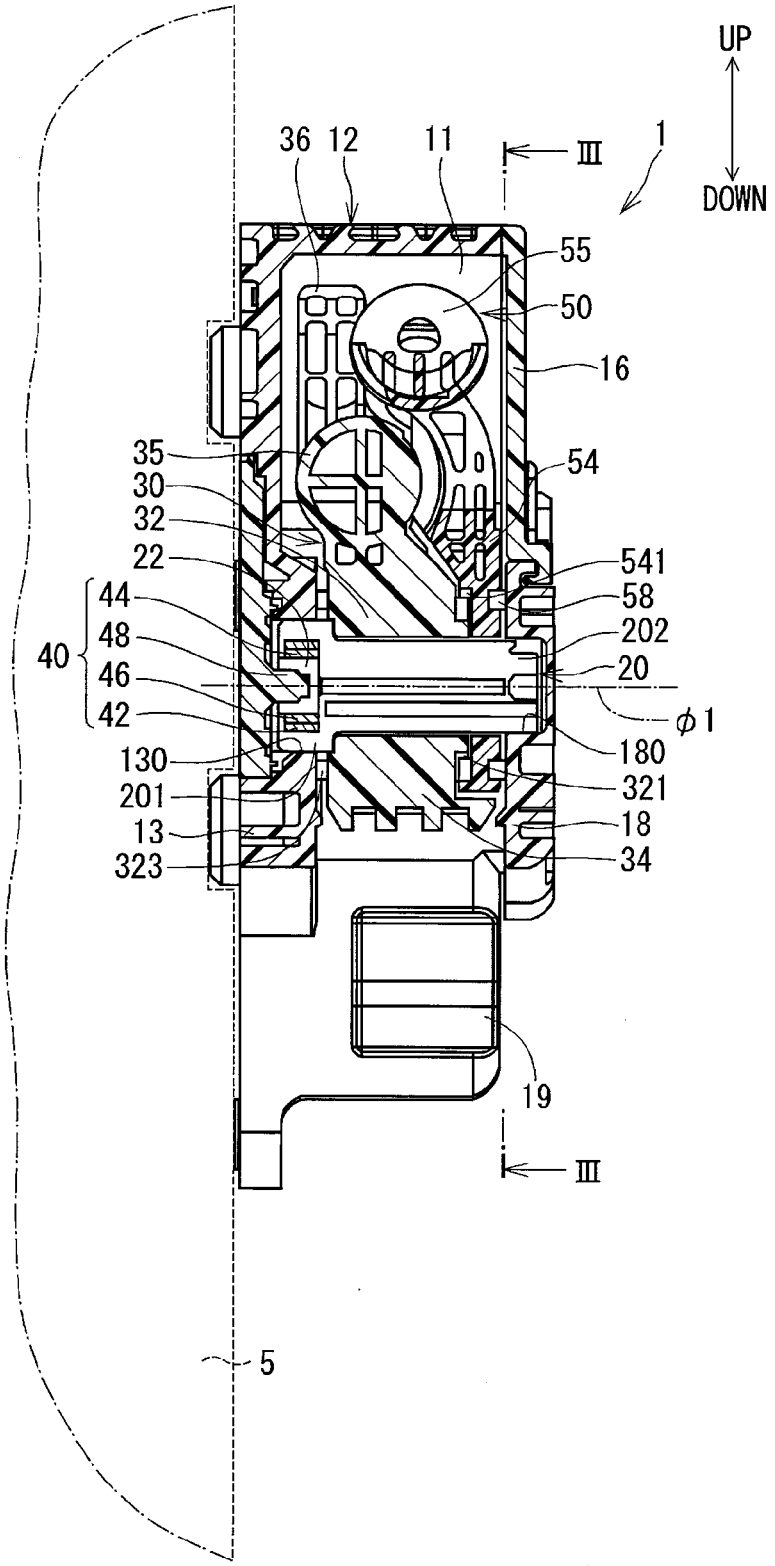
FIG. 4 is a schematic cross sectional view taken along a line IV-IV in FIG. 3.

Each of the first cover member 16 and the second cover member 18 is fixed to the housing 12 so as to be parallel to the shaft supporting portion 13. The first cover member 16 is formed in an almost rectangular flat plate shape and connected to each axial end of the upper-side wall portion 14, the back-side wall portion 15 and the front-side wall portion 17. In other words, as shown in FIG. 4, the first cover member 16 is connected to each right-hand end of the wall portions 14, 15 and 17, which is located on an opposite side to the shaft supporting portion 13. The first cover member 16 is also connected to the second cover member 18. The first cover member 16 prevents extraneous material from going into the inner space 11 of the acceleration device 1.

The second cover member 18 is formed in a triangular flat plate shape and connected to the housing 12 by multiple bolts 186 at each axial end of the back-side wall portion 15 and the front-side wall portion 17, which is located on the opposite side to the shaft supporting portion 13. A circular recessed portion is formed in an inner wall of the second cover member 18 in order to movably support the other axial end 202 of the pedal shaft 20 (hereinafter, a second axial end 202). In other words, an inner peripheral surface of the circular recessed portion corresponds to a bearing portion 180 for rotatably supporting the second axial end 202 of the pedal shaft 20. A gap is likewise formed between the inner peripheral surface of the bearing portion 180 and the outer peripheral surface of the pedal shaft 20.

An outer wall surface of the second cover member 18 is formed with net-like concavities and convexities, in order to increase rigidity against external forces applied to the second cover member 18. The second cover member 18 also prevents extraneous material from going into the inner space 11 of the acceleration device 1.

The pedal shaft 20 is horizontally arranged in the acceleration device 1, as best shown in FIG. 4. A sensor accommodating space 22 is formed in the first axial end 201 of the pedal shaft 20 for accommodating a detecting portion of the rotational angle sensor 40.

The pedal shaft 20 is rotated depending on a torque inputted from the acceleration pedal 28, which is operated by the vehicle driver. The pedal shaft 20 is rotatable within a predetermined angular range from an acceleration fully-closed position to the acceleration fully-opened position. The acceleration fully-closed position corresponds to a position, in which the opening degree of the acceleration pedal 28 (the stepping stroke amount of the acceleration pedal 28) is 0 (zero) %.

A direction of the rotational movement of the pedal shaft 20 from the acceleration fully-closed position to the acceleration fully-opened position (that is, the rotation in the anticlockwise direction in FIG. 3) is referred to as the acceleration opening direction. On the other hand, a direction of the rotational movement of the pedal shaft 20 from the acceleration fully-opened position to the acceleration fully-closed position (that is, the rotation in a clockwise direction in FIG. 3) is referred to as an acceleration closing direction.

The rotating member 30 is composed of a boss portion 32, an arm connecting portion 34, a spring holding portion 35, a full-close side stopper portion 36 and so on, wherein those portions 32, 34, and 36 are integrally formed as one unit. The full-close side stopper portion 36 is hereinafter referred to as a stopper arm.

The boss portion 32 is formed in a tubular shape having a through-hole with a circular cross section and provided between the shaft supporting portion 13 and the second cover member 18. The boss portion 32 is fixed to the outer peripheral surface of the pedal shaft 20 by, for example, a press-fit process, so that a center axis of the boss portion 32 is coaxial with a center axis "ϕ1" of the pedal shaft 20 and the boss portion 32 is rotated together with the pedal shaft 20.

Multiple helical gear teeth 321 (first gear teeth 321) are integrally formed with the boss portion 32 at an axial end surface of the boss portion 32 on a side to the second cover member 18 (that is, an axial end surface of the boss portion 32 on a right-hand side in FIG. 4 and hereinafter referred to as a second axial end surface). The multiple first gear teeth 321 are formed at equal intervals in a circumferential direction. Each of the first gear teeth 321 has an inclined tooth surface, which is more elevated toward a rotor 54 of a hysteresis mechanism 50 in the acceleration closing direction of the circumferential direction. In other words, a point on the inclined tooth surface of the first gear teeth 321 is closer to the rotor 54, as the point is moved on the inclined tooth surface in the acceleration closing direction.

A first friction member 323 is provided at another axial end surface of the boss portion 32 on a side to the shaft supporting portion 13 (that is, an axial end surface of the boss portion 32 on a left-hand side in FIG. 4 and hereinafter referred to as a first axial end surface). The first friction member 323 is formed in an annular shape. The first friction member 323 is provided between the boss portion 32 and an inner wall of the housing 12 at a radial-outside position of the pedal shaft 20. When the boss portion 32 is pushed in a direction away from the rotor 54, that is, in a direction to the shaft supporting portion 13, the boss portion 32 is coupled to the first friction member 323 in a friction coupling manner. A frictional force between the boss portion 32 and the first friction member 323 works as a rotational resistance of the boss portion 32.

One end of the arm connecting portion 34 is connected to a radial-outward peripheral portion of the boss portion 32, while the other end of the arm connecting portion 34 outwardly projects to the outside of the supporting body 10 through the opening 111.

The spring holding portion 35 is arranged in the inner space 11 and extends from the boss portion 32 in a radial-upward direction. The spring holding portion 35 holds one end of the return spring 39.

The stopper arm 36 is also arranged in the inner space 11 and further extends from the spring holding portion 35 in the radial-upward direction. The stopper arm 36 has a forward end 360 working as a contacting portion 360. When the contacting portion 360 of the stopper arm 36 is brought into contact with a stopper surface 151 formed by an inner wall of the back-side wall portion 15, the rotational movement of the rotating member 30 in the acceleration closing direction is stopped. Accordingly, the rotational movement of the rotating member 30 is limited at the acceleration fully-closed position. The stopper arm 36 and the stopper surface 151 of the back-side wall portion 15 will be explained more in detail below.

Figure 2:
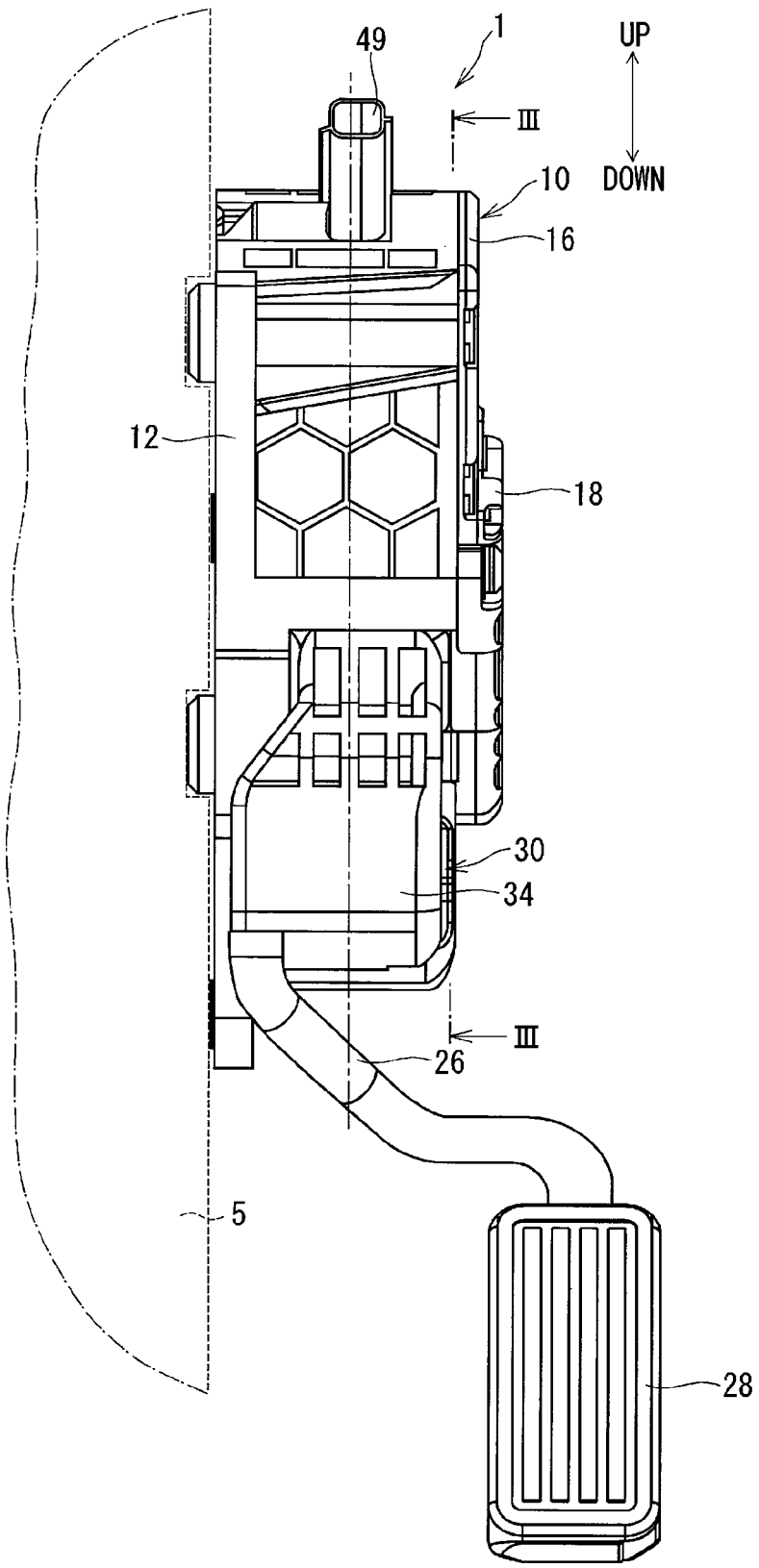
FIG. 2 is a schematic side view of the acceleration device when viewed in a direction of an arrow II in FIG. 1.

As shown in FIG. 2, one end (an upper end) of the pedal arm 26 is connected to the arm connecting portion 34 of the rotating member 30, while the other end (a lower end) extends in a downward direction. In the present embodiment, the pedal arm 26 downwardly extends and is connected to the acceleration pedal 28, which is located at a position extending in a right-hand direction from the housing 12 of the acceleration device 1. A stepping movement of the acceleration pedal 28 by the vehicle driver is converted into the rotational movement of the pedal shaft 20 (the rotation at the center axis "ϕ1") via the rotating member 30.

When the acceleration pedal 28 is rotated in the acceleration opening direction, a rotational angle of the pedal shaft 20 with respect to the acceleration fully-closed position (a starting point for the rotational movement of the pedal shaft 20) is increased in the acceleration opening direction. The opening degree of the acceleration pedal 28 is increased in accordance with the increase of the rotational angle of the pedal shaft 20. On the other hand, when the acceleration pedal 28 is rotated in the acceleration closing direction, the rotational angle of the pedal shaft 20 with respect to the starting point is decreased and the opening degree of the acceleration pedal 28 is decreased in accordance with the decrease of the rotational angle of the pedal shaft 20.

The return spring 39 is composed of a coil spring, one end of which is in contact with an inner wall 171 of the front-side wall portion 17. The return spring 39 (also referred to as a biasing member) biases the rotating member 30 in the acceleration closing direction. A biasing force applied to the rotating member 30 by the return spring 39 becomes larger as the rotational angle of the rotating member 30, that is, the rotational angle of the pedal shaft 20, becomes larger. The biasing force is so set that the rotating member 30 as well as the pedal shaft 20 is returned to the acceleration fully-closed position (the starting point) independently of a rotational position of the rotating member 30.

The rotational angle sensor 40 is composed of a yoke 42, a pair of permanent magnets 44 and 46 magnetized in different directions to each other, a hall element 48 and so on. The yoke 42 is made of magnetic material and formed in a cylindrical shape. The yoke 42 is attached to an inner wall of the sensor accommodating space 22 of the pedal shaft 20. The magnets 44 and 46 are arranged in an inside of the yoke 42 so as to oppose to each other in a radial direction of the pedal shaft 20 across the center axis "ϕ1" of the pedal shaft 20. Each of the magnets 44 and 46 is fixed to an inner wall of the yoke 42. The hall element 48 is arranged at a position between the magnets 44 and 46. The rotational angle sensor 40 is also referred to as a rotational angle detecting unit.

Voltage is generated at the hall element 48 when magnetic field is applied to the hall element 48, so that electric current flows in the hall element 48. This phenomenon is called as Hall effect.

Density of magnetic flux passing through the hall element 48 is changed when the magnets 44 and 46 are rotated together with the pedal shaft 20 around the center axis "ϕ1" of the pedal shaft 20. Amplitude of the generated voltage is in proportion to the density of the magnetic flux passing through the hall element 48. The rotational angle sensor 40 detects the voltage generated at the hall element 48 in order to detect a relative rotational angle between the hall elements 48 and the magnets 44 and 46, that is, the rotational angle of the pedal shaft 20 with respect to the supporting body 10. The rotational angle sensor 40 outputs an electric signal, which represents the detected rotational angle. The electric signal is transmitted to an outside electronic control unit (not shown), which is provided above the acceleration device 1, via an outside connector 49.

The hysteresis mechanism 50 is composed of the rotor 54, a second friction member 58, a hysteresis spring 59 and so on.

The rotor 54 is provided between the boss portion 32 and an inner wall of the second cover member 18 and at a radial-outward position of the pedal shaft 20. The rotor 54 is formed in an annular shape and rotatable relative to the pedal shaft 20 and the boss portion 32. In addition, the rotor 54 is movable in the axial direction of the pedal shaft 20 with respect to the boss portion 32, so that the rotor 54 is moved closer to or more separated from the boss portion 32. Multiple second helical gear teeth 541 are integrally formed with the rotor 54 on an axial side surface thereof facing to the boss portion 32. The multiple second gear teeth 541 are formed at equal intervals in a circumferential direction of the rotor 54. In a similar manner to the first gear teeth 321, each of the second gear teeth 541 has an inclined tooth surface, which is more elevated toward the boss portion 32 in the acceleration opening direction of the circumferential direction. In other words, a point on the inclined tooth surface of the second gear teeth 541 is closer to the boss portion 32, as the point is moved on the inclined tooth surface in the acceleration opening direction.

Since the first gear teeth 321 and the second gear teeth 541 are engaged with each other in the circumferential direction of the pedal shaft 20, the rotational force can be transmitted from the first gear teeth 321 to the second gear teeth 541, or vice versa. Therefore, the rotation of the boss portion 32 in the acceleration opening direction can be transmitted to the rotor 54 via the first gear teeth 321 and the second gear teeth 541. On the other hand, the rotation of the rotor 54 in the acceleration closing direction can be transmitted to the boss portion 32 via the second gear teeth 541 and the first gear teeth 321.

When the boss portion 32 is not in the acceleration fully-closed position (the starting point) but at such a rotational position, which is on a side toward the acceleration fully-opened position, the inclined tooth surfaces of the first and second gear teeth 321 and 541 are engaged with each other and the boss portion 32 and the rotor 54 are pushed by each other so as to move in the axial direction of the pedal shaft 20 away from each other. A pushing force of the first gear teeth 321 for pushing the boss portion 32 toward the shaft supporting portion 13 becomes larger, when the rotational angle of the boss portion 54 is increased in the acceleration opening direction from the acceleration fully-closed position. In a similar manner, a pushing force of the second gear teeth 541 for pushing the rotor 54 toward the second cover member 18 becomes larger, when the rotational angle of the boss portion 32 is increased in the acceleration opening direction from the acceleration fully-closed position.

The second friction member 58 is formed in an annular shape and provided between the rotor 54 and the inner wall of the second cover member 18 at a radial-outward position of the pedal shaft 20.

When the rotor 54 is pushed in the direction away from the boss portion 32, that is, in the direction to the second cover member 18, the rotor 54 is coupled to the second friction member 58 in the friction coupling manner. A frictional force between the rotor 54 and the second friction member 58 works as a rotational resistance of the rotor 54.

The hysteresis spring 59 is composed of a coil spring, one end of which is held at a spring holding portion 552 of a spring-force receiving arm 55. The spring-force receiving arm 55 extends from the rotor 54 in the radial-upward direction in the inner space 11. The other end of the hysteresis spring 59 is in contact with the inner wall 171 of the front-side wall portion 17. The hysteresis spring 59 biases the rotor 54 in the acceleration closing direction. A biasing force of the hysteresis spring 59 becomes larger as the rotational angle of the rotor 54 becomes larger. A torque applied to the rotor 54 by the biasing force of the hysteresis spring 59 is transmitted to the boss portion 32 via the second gear teeth 541 and the first gear teeth 321.

In the acceleration device 1 of the present embodiment, characteristic features exist in the structure and/or shape of the rotating member 30, the stopper surface 151 of the back-side wall portion 15 and the bearing portions 130 and 180. The characteristic features of the present embodiment will be explained with reference to FIGS. 5A and 5B and FIGS. 6A and 6B.

Figure 3:
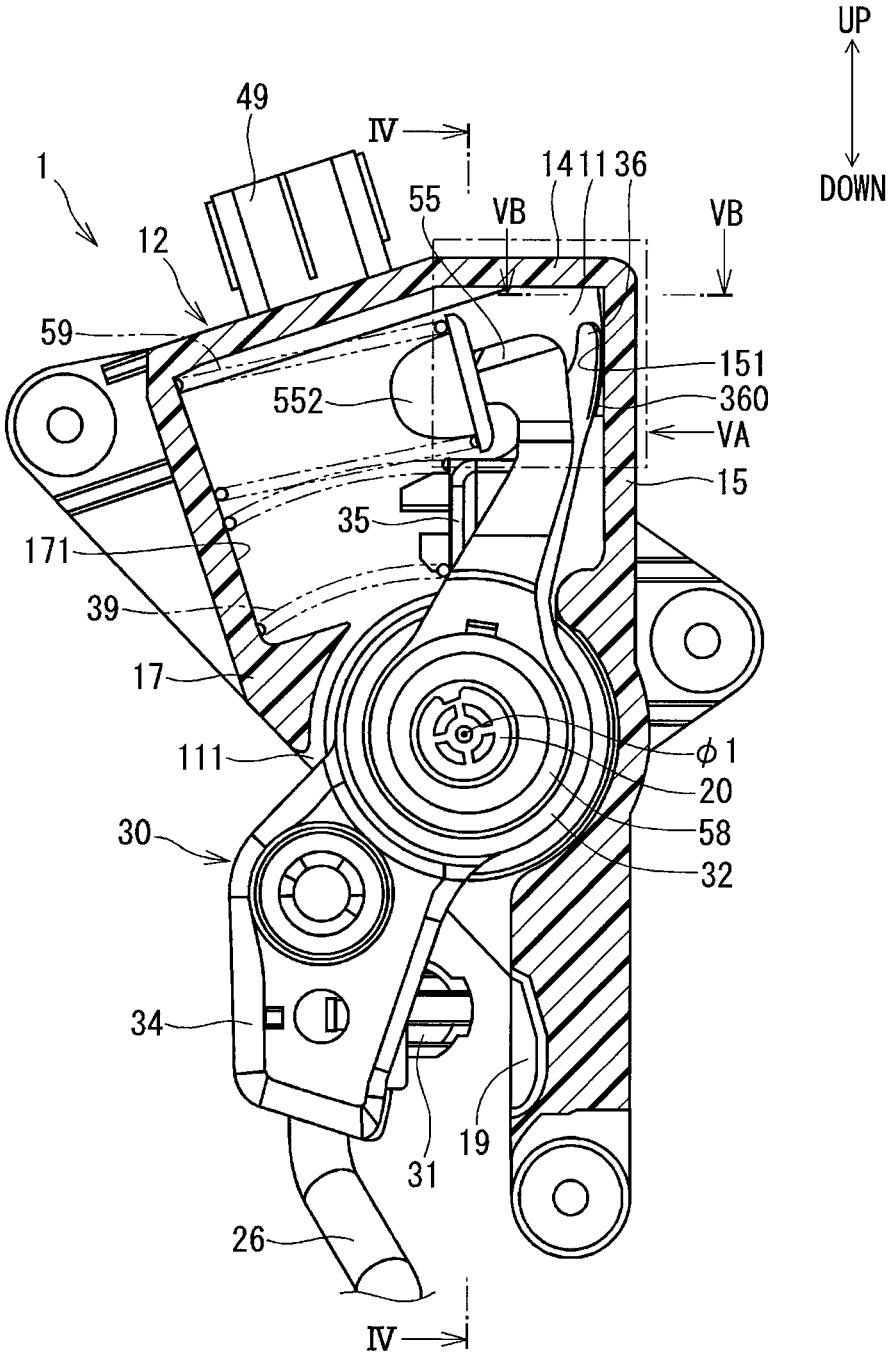
FIG. 3 is a schematic cross sectional view taken along a line in FIG. 2.
Figure 5A:
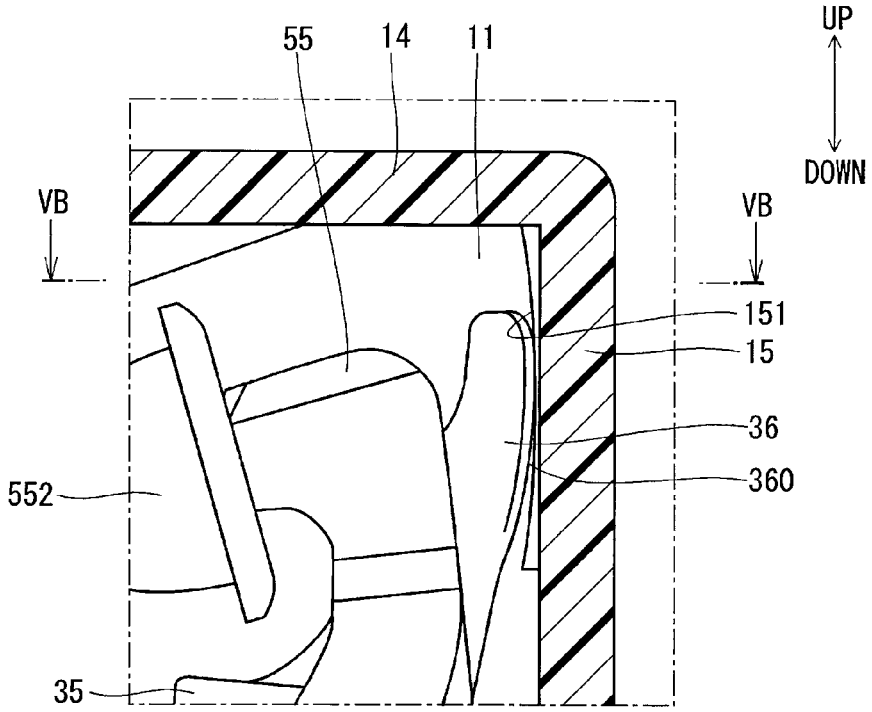
FIG. 5A is a schematically enlarged view of a portion VA in FIG. 3.

FIG. 5A is an enlarged view showing a portion VA indicated in FIG. 3. FIG. 5A is a cross sectional view of a part of the acceleration device 1 when viewed the acceleration device 1 from a side point. FIG. 5A shows a condition in which the stopper arm 36 is in contact with the stopper surface 151 of the back-side wall portion 15, that is, the condition of the starting point of the rotating member 30 and the rotor 54.

Figure 5B:
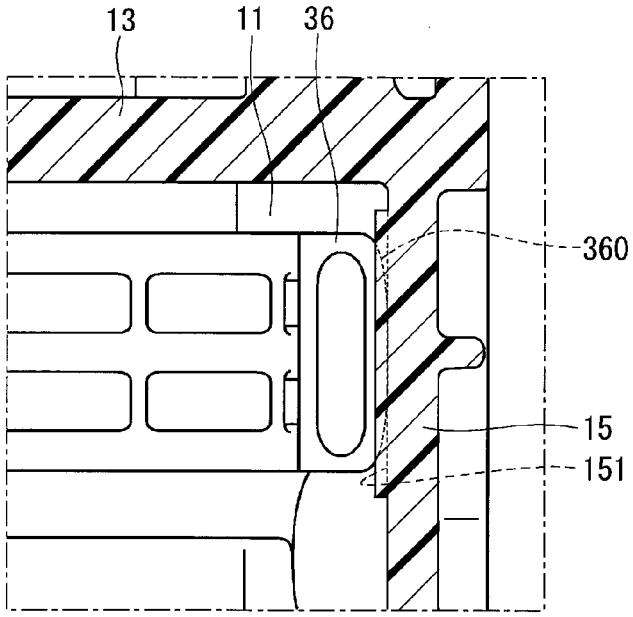
FIG. 5B is a schematically enlarged cross sectional view taken along a line VB-VB in FIG. 3.

FIG. 5B is a cross sectional view taken along a line VB-VB in FIG. 3 and FIG. 5A, when viewed the acceleration device 1 from an upper side thereof. FIG. 5B also shows the condition in which the stopper arm 36 is in contact with the stopper surface 151 of the back-side wall portion 15.

Figure 6A:
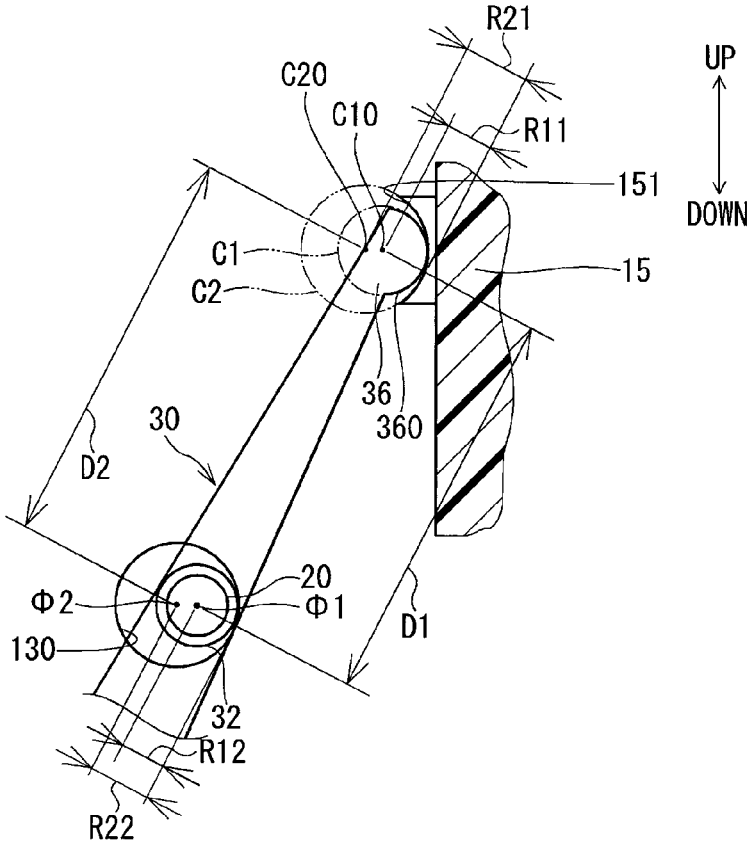
FIGS. 6A and 6B are schematic views for explaining an operation of the acceleration device according to the embodiment of the present disclosure.
Figure 6B:
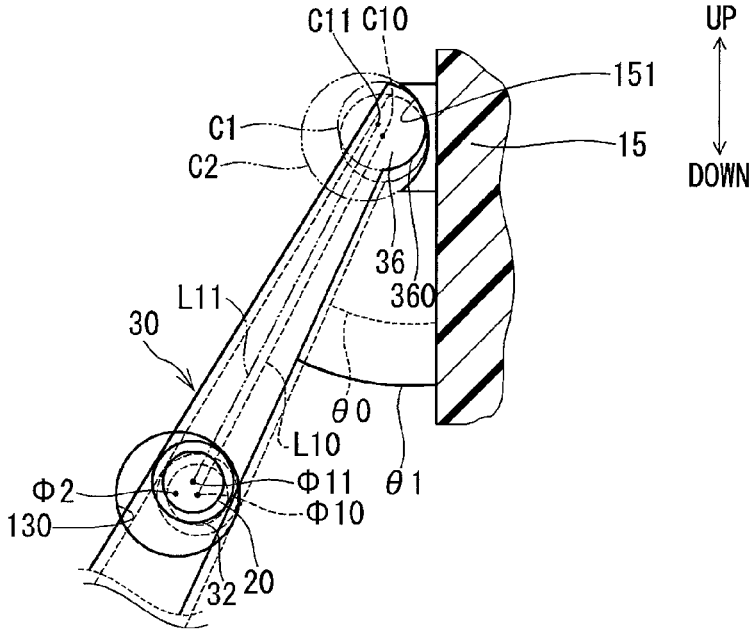

FIGS. 6A and 6B are schematic views, each of which shows a positional relationship among the rotating member 30, the stopper surface 151 of the back-side wall portion 15 and the bearing portion 130 in the acceleration fully-closed condition. FIG. 6A is the schematic view showing the positional relationship among the rotating member 30, the stopper surface 151 and the bearing portion 130 of the acceleration device 1 in an initial condition thereof. FIG. 6B is the schematic view showing the positional relationship among the rotating member 30, the stopper surface 151 and the bearing portion 130, when a position of the center axis "ϕ1" of the pedal shaft 20 with respect to a center axis "ϕ2" of the bearing portion 130 is displaced from its initial position.

The bearing portion 180 has the same cross sectional shape to that of the bearing portion 130 and has the same center axis to that (ϕ2) of the bearing portion 130. Since the explanation for the bearing portion 130 is also applied to the bearing portion 180, the explanation for the bearing portion 180 is omitted.

As shown in FIG. 5A and FIG. 6A, an outer surface of the contacting portion 360 of the stopper arm 36 is formed in a circular arc shape in its cross section on a virtual plane extending in a direction perpendicular to the center axis "ϕ1" of the pedal shaft 20. More exactly, as shown in FIG. 6A, the outer surface of the contacting portion 360 corresponds to a part of a first virtual circle "C1". A radius "R11" of the outer surface of the contacting portion 360 (that is, a radius of the first virtual circle "C1") is made to be equal to a radius "R12" of an inner peripheral wall of the boss portion 32, which is equal to a radius of a portion of the pedal shaft 20 rotatably supported by the bearing portion 130. As shown in FIG. 5B, the outer surface of the contacting portion 360 is formed in a curved surface in a direction parallel to the center axis "ϕ1" of the pedal shaft 20.

As shown in FIG. 5A and FIGS. 6A and 6B, the stopper surface 151 of the back-side wall portion 15 is also formed in a circular arc shape in its cross section on the virtual plane extending in the direction perpendicular to the center axis "ϕ1" of the pedal shaft 20. More exactly, as shown in FIG. 6A, the stopper surface 151 corresponds to a part of a second virtual circle "C2". A radius "R21" of the stopper surface 151 (that is, a radius of the second virtual circle "C2") is made to be equal to a radius "R22" of an inner peripheral surface of the bearing portion 130. As shown in FIG. 5B, a cross sectional line of the stopper surface 151 is formed in a straight line in a direction parallel to the center axis "ϕ1" of the pedal shaft 20.

As shown in FIG. 6A, a distance "D1" between a center of the pedal shaft 20 (the center axis "ϕ1" of the pedal shaft 20) and a center "C10" of the first virtual circle "C1" is made to be equal to a distance "D2" between a center of the bearing portion 130 (the center axis "ϕ2" of the bearing portion 130) and a center "C20" of the second virtual circle "C2".

An operation of the acceleration device 1 will be explained with reference to FIG. 7.

When the acceleration pedal 28 is stepped on, the rotating member 30 is rotated together with the pedal shaft 20 around the center axis "ϕ1" of the pedal shaft 20 in the acceleration opening direction, depending on the stepping force applied to the acceleration pedal 28. In this operation, the stepping force is necessary to generate such a torque, which is larger than a sum of a torque of the biasing force of the return spring 39, a torque of the biasing force of the hysteresis spring 59, and a torque of the resistance force generated by the friction force of the first friction member 323 and the second friction member 58.

The resistance force generated by the friction force of the first friction member 323 and the second friction member 58 so works as to suppress the rotation of the acceleration pedal 28 (that is, the pedal shaft 20) in the acceleration opening direction, when the acceleration pedal 28 is stepped on.

Figure 7:
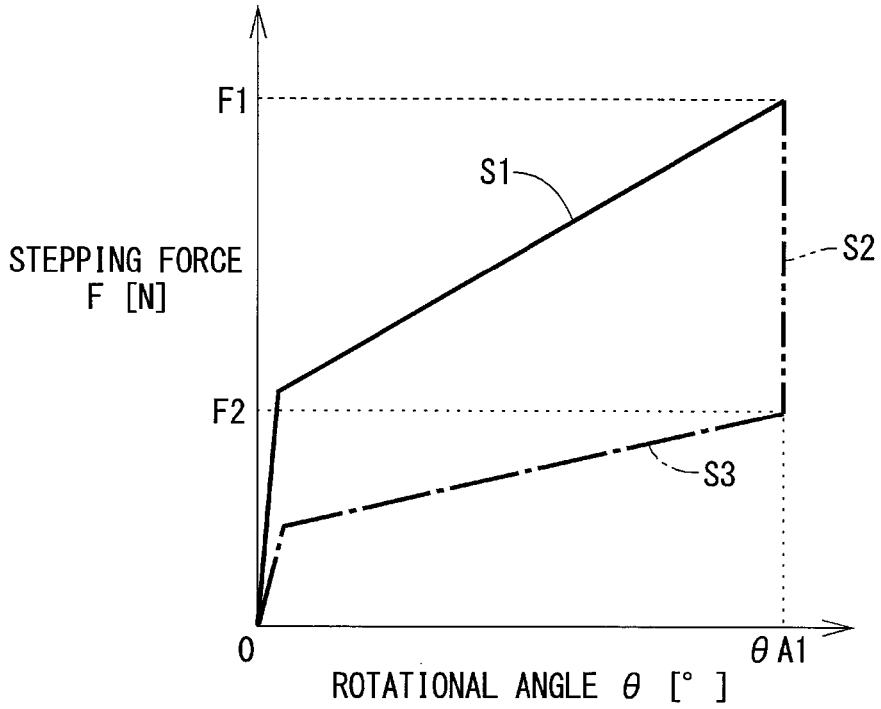
FIG. 7 is a characteristic line for explaining a hysteresis mechanism and its operation for the acceleration device according to the embodiment of the present disclosure.

FIG. 7 shows a relationship between the rotational angle "θ" of the pedal shaft 20 and the stepping force "F" for the acceleration pedal 28. More exactly, a solid line S1 shows the relationship between the rotational angle "θ" and the stepping force "F" when the acceleration pedal 28 is stepped forward, while a one-dot-chain line S3 shows the relationship between the rotational angle "θ" and the stepping force "F" when the acceleration pedal 28 is stepped back. As shown in FIG. 7, the stepping force "F" when the acceleration pedal 28 is stepped forward (the solid line S1) at a certain rotational angle (for example, at an angle of "θA1") is larger than the stepping force "F" when the acceleration pedal 28 is maintained (the one-dot-chain line S3) at the same rotational angle (at the angle of "θA1").

When the acceleration pedal 28 is maintained at a stepped-forward position after the acceleration pedal 28 is stepped forward, it is necessary that the stepping force generates such a torque which is larger than a difference between the torque of the biasing force of the return spring 39 and the hysteresis spring 59 and the torque of resistance force generated by the friction force of the first friction member 323 and the second friction member 58. In other words, the vehicle driver may decrease the stepping force by a certain amount (corresponding to a decrease of the torque of the resistance force generated by the friction force) after the acceleration pedal 28 has been stepped forward, when the vehicle driver maintains the stepped-forward position of the acceleration pedal 28.

For example, as shown by a two-dot-chain line S2 in FIG. 7, when the vehicle driver maintains the stepped-forward position of the acceleration pedal 28 after he stepped forward the acceleration pedal 28 to a position corresponding to the rotational angle "θA1", the vehicle driver can decrease its stepping force from "F1" to "F2". As a result, it becomes easier for the vehicle driver to keep its stepped-forward position. The resistance force generated by the friction force of the first friction member 323 and the second friction member 58 is decreased when the pedal shaft 28 is rotated in the acceleration closing direction and/or when the pedal shaft 28 is maintained at any constant position. As a result, the necessary stepping force is decreased when the acceleration pedal 28 is rotated in the acceleration closing direction and/or when the acceleration pedal 28 is maintained at its stepped-forward position.

When the torque generated by the stepping force becomes such a value, which is smaller than the difference between the torque of the biasing force of the return spring 39 and the hysteresis spring 59 and the torque of resistance force generated by the friction force of the first friction member 323 and the second friction member 58, the rotational position of the acceleration pedal 28 returns to its acceleration fully-closed position. In this operation, it is sufficient for the vehicle driver to stop his stepping-forward motion and to release the stepping force from the acceleration pedal 28 in order to quickly return the acceleration pedal 28 to the acceleration fully-closed position. Therefore, it does not place an additional burden on the vehicle driver. On the other hand, in a case that the acceleration pedal 28 is gradually returned to the acceleration fully-closed position, it is necessary for the vehicle driver to continuously apply his stepping force of a certain amount to the acceleration pedal 28 and to gradually decrease the stepping force.

For example, as indicated by the one-dot-chain line S3 in FIG. 7, when the position of the acceleration pedal 28 is gradually returned from its stepped-forward position at the rotational angle "θA1" to its initial position, the stepping force is gradually adjusted from "F2" to "0". As shown in FIG. 7, the stepping force "F2" is smaller than the stepping force "F1". Therefore, the burden placed on the vehicle driver becomes smaller, when the stepped-forward position of the acceleration pedal 28 is returned to the initial position or to any position, at which the rotational angle is smaller. As explained above, the resistance force generated by the friction force of the first friction member 323 and the second friction member 58 is decreased, when the acceleration pedal 28 is rotated in the acceleration closing direction. Accordingly, as indicated by the one-dot-chain line S3 in FIG. 7, the stepping force "F" necessary for stepping back the acceleration pedal 28 at any rotational angle "A" is smaller than the stepping force "F" (indicated by the solid line S1) necessary for stepping forward the acceleration pedal 28 at the same rotational angle "θ".

When the acceleration pedal 28 of the acceleration device 1 is operated, the acceleration pedal 28 is moved forward and/or backward. In some of cases, when the acceleration pedal 28 returns to its initial position (the acceleration fully-closed position), the position of the center axis "ϕ1" of the pedal shaft 20 with respect to the center axis "ϕ2" of the bearing portion 130 may be displaced from its initial position.

An operation of the acceleration device 1, in which the position of the center axis "ϕ1" of the pedal shaft 20 with respect to the center axis "ϕ2" of the bearing portion 130 is displaced from its initial position, will be hereinafter explained with reference to FIGS. 6A, 6B, 8A and 8B. The operation of the acceleration devices 1 between the present embodiment and a comparison example will be compared.

Figure 8A:
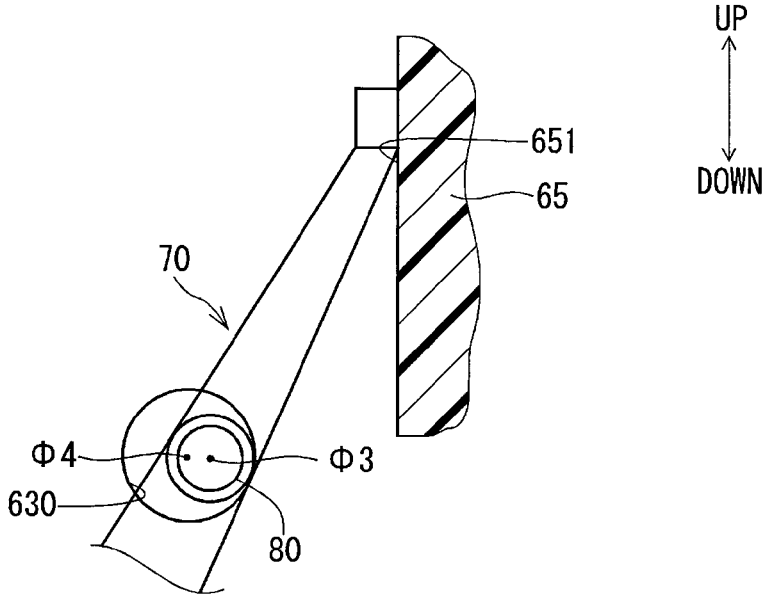
FIGS. 8A and 8B are schematic views for explaining an operation of an acceleration device according to a comparison example.
Figure 8B:
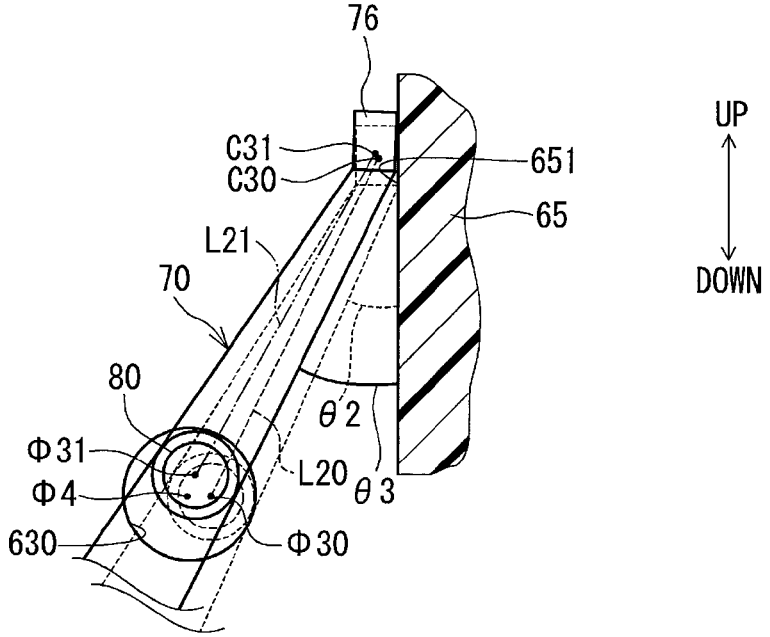

FIGS. 8A and 8B are schematic views showing the acceleration device of the comparison example, in which an outer surface of a contacting portion as well as a stopper surface (an inner wall of a supporting body) is formed by a flat surface. More exactly, FIG. 8A is the schematic view of the acceleration device according to the comparison example for showing a positional relationship among a rotating member 70, the inner wall 651 (the stopper surface) of a back-side wall portion 65 and a bearing portion 630. And FIG. 8B is the schematic view for showing a positional relationship among the rotating member 70, the inner wall 651 (the stopper surface) of the back-side wall portion 65 and the bearing portion 630, when a position of a center axis "ϕ3" of a pedal shaft 80 with respect to a center axis "ϕ4" of the bearing portion 630 is displaced from its initial position. In FIG. 6B (the present embodiment) and FIG. 8B (the comparison example), the positional relationship among the rotating member, the back-side wall portion and the bearing portion in the initial condition is indicated by a dotted line.

In the acceleration device, an inner diameter of the bearing portion is generally larger than an outer diameter of the pedal shaft. As a result, the position of the center axis of the pedal shaft with respect to the center axis of the bearing portion is inevitably changed, when the acceleration device is operated.

In FIG. 6B, "ϕ10" shows an initial position of the center axis of the pedal shaft 20, while "ϕ11" shows a displaced position of the center axis of the pedal shaft 20. "C10" is an initial position of the center of the first virtual circle "C1", while "C11" is a displaced position of the center of the first virtual circle "C1". A first virtual straight line "L10" corresponds to a line connecting the initial position "ϕ10" of the center axis "ϕ1" of the pedal shaft 20 and the initial position "C10" of the center of the first virtual circle "C1". A second virtual straight line "L11" corresponds to a line connecting the displaced position "ϕ11" of the center axis "ϕ1" of the pedal shaft 20 and the displaced position "C11" of the center of the first virtual circle "C1". As shown in FIG. 6B, according to the acceleration device 1 of the present embodiment, the first virtual straight line "L10" is shifted to the second virtual straight line "L11", which is parallel to the first virtual straight line "L10", when the center axis "ϕ1" of the pedal shaft 20 is displaced with respect to the center axis "ϕ2" of the bearing portion 130, from "ϕ10" to "ϕ11".

In FIG. 6B, "θ0" is an angle of the rotating member 30 with respect to the back-side wall portion 15 before the position of the center axis "ϕ1" of the pedal shaft 20 with respect to the center axis "ϕ2" of the bearing portion 130 is displaced from its initial position. "θ1" is an angle of the rotating member 30 with respect to the back-side wall portion 15 after the position of the center axis "ϕ1" of the pedal shaft 20 with respect to the center axis "ϕ2" of the bearing portion 130 is displaced from its initial position. As a result of the above parallel shift of the virtual straight line from "L10" to "L11", the angle of the rotating member 30 ("θ0" and "θ1") is not changed before and after the displacement of the center axis "ϕ1" of the pedal shaft 20 with respect to the center axis "ϕ2" of the bearing portion 130.

In FIG. 8B showing the comparison example, "ϕ30" shows an initial position of the center axis of the pedal shaft 80, while "931" shows a displaced position of the center axis of the pedal shaft 80. "C30" is an initial position of a center of a contacting portion 76, while "C31" is a displaced position of the center of the contacting portion 76. A first virtual straight line "L20" corresponds to a line connecting the initial position "ϕ30" of the center axis of the pedal shaft 80 and the initial position "C30" of the center of the contacting portion 76. A second virtual straight line "L21" corresponds to a line connecting the displaced position "ϕ31" of the center axis of the pedal shaft 80 and the displaced position "C31" of the center of the contacting portion 76. As shown in FIG. 8B, according to the comparison example, the first virtual straight line "L20" is shifted to the second virtual straight line "L21", when the center axis "ϕ3" of the pedal shaft 80 is displaced with respect to the center axis "ϕ4" of the bearing portion 630, from "ϕ30" to "ϕ31". However, the second virtual straight line "L21" is not parallel to the first virtual straight line "L20".

In FIG. 8B, "θ2" is an angle of the rotating member 70 with respect to the back-side wall portion 65 before the position of the center axis "ϕ3" of the pedal shaft 80 with respect to the center axis "ϕ4" of the bearing portion 630 is displaced from its initial position. "θ3" is an angle of the rotating member 70 with respect to the back-side wall portion 65 after the position of the center axis "ϕ3" of the pedal shaft 80 with respect to the center axis "ϕ4" of the bearing portion 630 is displaced from its initial position. As a result of the above non-parallel shift of the virtual straight line from "L20" to "L21", the angles of the rotating member 70 ("θ2" and "θ3") are different from each other before and after the displacement of the center axis "ϕ3" of the pedal shaft 80 with respect to the center axis "ϕ4" of the bearing portion 630.

As a result, in the comparison example, the rotational angle of the pedal shaft 80 at the acceleration fully-closed position is not stable. In other words, the signal outputted from the rotational angle sensor, which detects the rotational angle of the pedal shaft 80, becomes unstable.

As above, according to the acceleration device 1 of the present embodiment, the first virtual straight line "L10" (which connects the center axis "C10" of the first virtual circle "C1" to the center axis "ϕ10" of the pedal shaft 20 in the initial condition) is shifted to the second virtual straight line "L11" (which connects the center axis "C11" of the first virtual circle "C1" to the center axis "ϕ11" of the pedal shaft 20 in the displaced condition), which is parallel to the first virtual straight line "L10", when the center axis "ϕ1" of the pedal shaft 20 with respect to the center axis "ϕ2" of the bearing portion 130 is displaced from the initial position (ϕ10) to the displaced position (ϕ11) in the condition that the acceleration pedal 28 is in its fully-closed position. As a result, the angle "θ0" of the rotating member 30 with respect to the back-side wall portion 15 is not changed (θ1=θ0), even when the position of the center axis "ϕ1" of the pedal shaft 20 with respect to the center axis "ϕ2" of the bearing portion 130 is displaced from the initial position to the displaced position. According to the acceleration device 1 of the present embodiment, therefore, the rotational angle sensor 40 detects the same rotational angle of the pedal shaft 20 in the acceleration fully-closed position, independently of the displacement of the position of the pedal shaft 20 with respect to the bearing portion 130. The electrical signal representing the detected rotational angle is transmitted to the outside electronic control unit.

(Other Embodiments and/or Modifications)

(1) In the above embodiment, each of the cross sectional shape for the outer surface of the contacting portion 360 in the vertical direction (that is, on the virtual plane perpendicular to the center axis of the pedal shaft 20), the cross sectional shape for the outer peripheral surface of the pedal shaft 20 in the vertical direction, the cross sectional shape for the stopper surface 151 of the back-side wall portion 15 in the vertical direction, and the cross sectional shape for the inner peripheral surface of the bearing portion 130 in the vertical direction is formed in the circular shape or the circular arc shape. However, the cross sectional shape for those related portions is not limited to the circular shape or the circular arc shape.

In the present disclosure, the outer peripheral surface of the pedal shaft 20 corresponds to an outer peripheral surface of the axial end of the pedal shaft 20 (for example, the first axial end 201), which is rotatably supported by the bearing portion 130.

For example, each of the cross sectional shape for the outer surface of the contacting portion 360 and the cross sectional shape for the outer peripheral surface of the pedal shaft 20 in the vertical direction may be formed in a curved surface (not a circular surface), wherein a curvature radius is changed in its circumferential direction and variation of the curvature radius is the same to each other between the curved surface for the contacting portion 360 and the curved surface for the outer peripheral surface of the pedal shaft 20. More exactly, the curvature radius of the curved surface for the outer surface of the contacting portion 360, which corresponds to a curvature radius in a radial direction on the virtual plane perpendicular to the center axis of the pedal shaft 20, is identical to the curvature radius of the curved surface for the outer peripheral surface of the pedal shaft 20, which corresponds to a curvature radius in the same radial direction on the virtual plane perpendicular to the center axis of the pedal shaft 20.

In a similar manner, each of the cross sectional shape for the stopper surface 151 of the back-side wall portion 15 and the cross sectional shape for the inner peripheral surface of the bearing portion 130 in the vertical direction may be formed in a curved surface (not a circular shape), wherein a curvature radius is changed in its circumferential direction and variation of the curvature radius is the same to each other between the curved surface for the stopper surface 151 and the curved surface for the inner peripheral surface of the bearing portion 130. More exactly, the curvature radius of the curved surface for the stopper surface 151 of the back-side wall portion 15 in a radial direction on the virtual plane perpendicular to the center axis of the pedal shaft 20 is identical to the curvature radius of the curved surface for the inner peripheral surface of the bearing portion 130 in the same radial direction on the virtual plane perpendicular to the center axis of the pedal shaft 20.

For example, the curvature radius for the curved surface may be changed in the circumferential direction in accordance with a predetermined mathematical rule, so that each of the cross sectional shapes for those related portions is formed not in the circular shape but in an oval shape.

As above, the present embodiment may be modified in such a way that the cross sectional shape for the outer surface of the contacting portion 360 and the cross sectional shape for the outer peripheral surface of the pedal shaft 20 are congruent to each other, and the cross sectional shape of the stopper surface 151 and the cross sectional shape for the inner peripheral surface of the bearing portion 130 are congruent to each other.

(2) In the above embodiment, the cross sectional shape for the contacting portion 360 of the stopper arm 36 in the horizontal direction is also formed in the curved shape (FIG. 5B). The cross sectional shape of the contacting portion in the horizontal direction is not limited to the curved shape.

(3) In the above embodiment, the acceleration device has the hysteresis mechanism. It is not always necessary to provide the hysteresis mechanism in the acceleration device.

The present disclosure should not be limited to the above embodiments and/or modifications, but can be modified in various manners without departing from the spirit of the present disclosure.

What is claimed is:

1. An acceleration device for an automotive vehicle comprising:

an acceleration pedal to be operated by a vehicle driver;

a supporting body to be fixed to a vehicle body;

a pedal shaft rotatably supported by a bearing portion formed in the supporting body;

a boss portion attached to and rotated together with the pedal shaft;

a stopper arm connected to the boss portion and arranged in an inner space formed by the supporting body, the stopper arm having a contacting portion which is brought into contact with a stopper surface of the supporting body when the acceleration pedal is in an acceleration fully-closed position;

a pedal arm for connecting the acceleration pedal to the boss portion;

a rotational angle detecting unit for detecting a rotational angle of the pedal shaft with respect to the supporting body; and a biasing member for biasing rotation of the pedal shaft in an acceleration closing direction, wherein each of an outer surface of the contacting portion and an outer peripheral surface of the pedal shaft is formed by a curved surface, and a cross-sectional shape for the outer surface of the contacting portion and a cross-sectional shape for the outer peripheral surface of the pedal shaft are equal to each other on a plane perpendicular to a center axis of the pedal shaft, wherein each of the stopper surface and an inner peripheral surface of the bearing portion is formed by a curved surface, and a cross-sectional shape for the stopper surface and a cross-sectional shape for the inner peripheral surface of the bearing portion are identical to each other on the plane perpendicular to the center axis of the pedal shaft, wherein a distance between a center of a first round shape and the center axis of the pedal shaft is equal to a distance between a center of a second round shape and a center axis of the bearing portion, wherein the first round shape includes the curved surface of the contacting portion as a part of the first round shape on the plane perpendicular to the center axis of the pedal shaft, and wherein the second round shape includes the curved surface of the stopper surface of the supporting body as a part of the second round shape on the plane perpendicular to the center axis of the pedal shaft.

2. An acceleration device for an automotive vehicle comprising:

an acceleration pedal to be operated by a vehicle driver;

a supporting body to be fixed to a vehicle body;

a pedal shaft rotatably supported by a bearing portion formed in the supporting body;

a boss portion attached to and rotated together with the pedal shaft;

a stopper arm connected to the boss portion and arranged in an inner space formed by the supporting body, the stopper arm having a contacting portion which is brought into contact with a stopper surface of the supporting body when the acceleration pedal is in an acceleration fully-closed position;

a pedal arm for connecting the acceleration pedal to the boss portion;

a rotational angle detecting unit for detecting a rotational angle of the pedal shaft with respect to the supporting body; and a biasing member for biasing rotation of the pedal shaft in an acceleration closing direction, wherein each of an outer surface of the contacting portion and an outer peripheral surface of the pedal shaft is formed by a circular surface, and a curvature radius for the outer surface of the contacting portion and a curvature radius for the outer peripheral surface of the pedal shaft are equal to each other on a plane perpendicular to a center axis of the pedal shaft, wherein each of the stopper surface and an inner peripheral surface of the bearing portion is formed by a circular surface, and a curvature radius of the stopper surface and a curvature radius of the inner peripheral surface of the bearing portion are equal to each other on the plane perpendicular to the center axis of the pedal shaft, wherein a distance between a center of a first circle and the center axis of the pedal shaft is equal to a distance between a center of a second circle and a center axis of the bearing portion, wherein the first circle includes the circular surface of the contacting portion as a part of the first circle on the plane perpendicular to the center axis of the pedal shaft, and wherein the second circle includes the circular surface of the stopper surface of the supporting body as a part of the second circle on the plane perpendicular to the center axis of the pedal shaft.

3. An acceleration device for an automotive vehicle comprising:

an acceleration pedal to be operated by a vehicle driver;

a supporting body to be fixed to a vehicle body;

a pedal shaft rotatably supported by a bearing portion formed in the supporting body;

a boss portion attached to and rotated together with the pedal shaft;

a stopper arm connected to the boss portion and arranged in an inner space formed by the supporting body, the stopper arm having a contacting portion which is brought into contact with a stopper surface of the supporting body when the acceleration pedal is in an acceleration fully-closed position;

a pedal arm for connecting the acceleration pedal to the boss portion;

a rotational angle detecting unit for detecting a rotational angle of the pedal shaft with respect to the supporting body; and a biasing member for biasing rotation of the pedal shaft in an acceleration closing direction, wherein each of an outer surface of the contacting portion and an outer peripheral surface of the pedal shaft is formed by a curved surface, each of a curvature radius for the curved surface of the contacting portion and a curvature radius for the curved surface of the outer peripheral surface of the pedal shaft is changed in its circumferential direction on a plane perpendicular to a center axis of the pedal shaft, and variations of the curvature radius for the curved surface of the contacting portion are equal to variations of the curvature radius for the curved surface of the outer peripheral surface of the pedal shaft, wherein each of the stopper surface of the supporting body and an inner peripheral surface of the bearing portion is formed by a curved surface, each of a curvature radius for the curved surface of the stopper surface and a curvature radius for the curved surface of the inner peripheral surface of the bearing portion is changed in its circumferential direction on the plane perpendicular to the center axis of the pedal shaft, and variations of the curvature radius for the curved surface of the stopper surface are equal to variations of the curvature radius for the curved surface of the inner peripheral surface of the bearing portion, wherein a distance between a center of a first round shape and the center axis of the pedal shaft is equal to a distance between a center of a second round shape and a center axis of the bearing portion, wherein the first round shape includes the curved surface of the contacting portion as a part of the first round shape on the plane perpendicular to the center axis of the pedal shaft, and wherein the second round shape includes the curved surface of the stopper surface of the supporting body as a part of the second round shape on the plane perpendicular to the center axis of the pedal shaft.

* * * * *